US005930923A

United States Patent [19]

Nishiguchi

[11] Patent Number: 5,930,923

[45] Date of Patent: Aug. 3, 1999

[54] METHOD FOR OPERATION TO EXCAVATE UNDERDRAIN IN THE FIELD GROUND AND A DEVICE FOR OPERATION TO EXCAVATE UNDERDRAIN

[75] Inventor: Motoji Nishiguchi, Ebetsu, Japan

[73] Assignee: Yugenkaisha Unit Shoji Limited, Ebetsu, Japan

[21] Appl. No.: 08/956,780

[22] Filed: Oct. 23, 1997

[30] Foreign Application Priority Data

Dec. 26, 1996 [JP] Japan ..... 8-356835

[51] Int. Cl.[6] ..... E02F 3/06; E02F 5/02; B65G 15/00; F16L 1/028

[52] U.S. Cl. ..... 37/351; 37/352; 37/355; 37/356; 37/357; 37/365; 37/464; 37/462; 37/465; 405/155; 405/174; 405/179

[58] Field of Search ..... 37/351, 352, 353, 37/355, 356, 357, 365, 464, 465, 462; 405/155, 174, 179

[56] References Cited

U.S. PATENT DOCUMENTS

| | | | |
|---|---|---|---|
| 333,114 | 12/1885 | Dougine | 405/179 |
| 1,744,942 | 1/1930 | Barber | 37/353 |
| 4,812,078 | 3/1989 | Rivard | 405/179 |
| 4,981,396 | 1/1991 | Albertson et al. | 405/178 |
| 5,434,200 | 7/1995 | Kolker et al. | 524/35 |
| 5,701,692 | 12/1997 | Woodall | 37/353 |

*Primary Examiner*—Thomas B. Will
*Assistant Examiner*—Gary S. Hartmann
*Attorney, Agent, or Firm*—Kanesaka & Takeuchi

[57] ABSTRACT

A method of operation to effectively excavate an underdrain in the field ground having a long service life and ensuring that the underdrain will not be closed after a long period of time and a device for such operation. The method includes attaching a plurality of buckets to an endless chain, driving the endless chain to excavate a slit in the field ground, reforming inner side walls of the slit by a reformer, pressing soil from both sides of the slit later ally inwardly by a pressing member attached to the reformer to form a block to separate the slit into an upper space and a Iover space, and charging the upper space with discarded dirt.

4 Claims, 10 Drawing Sheets

$D_1$
TR
10
22X
22A
4
3
2
1
21
22
20
22B
22Y
24
30
40
P
51
50

METHOD FOR OPERATION TO EXCAVATE UNDERDRAIN IN THE FIELD GROUND AND A DEVICE FOR OPERATION TO EXCAVATE UNDERDRAIN

BACKGROUND OF THE INVENTION

1. Field of the Invention

The present invention relates to a method for operation to excavate an underdrain and a device for such operation to excavate an underdrain. More particularly, the invention relates to a method for operation to excavate an underdrain with or without filling materials being used and a device for such operation.

2. Description of the Prior Art

For a conversion from rice paddy into a field cultivation, it is essential to improve water permeability and drainage in the field. For this purpose, open drainage and underdrainage have been recommended in the field while it is known that the under drain is more efficient in watery areas; that is, the acceleration of vertical permeation of surplus water is practiced as essential means. Many of conventional underdrainage excavating devices are of the type in which the plow section of a subsoiler is attached with a shell-shaped follower member or a so-called cannonball which is pulled by the tractor deep through the ground to form an underground space which is called a "shell" underdrain.

Particularly, the underdrain is not only suited to the conversion from the rice paddy cultivation to the field cultivation but also is most effective to the soil improvement of both the rice paddy and the field.

Conventionally, a known underdrain was made by forming a space in the field ground such that residual surface water or excess moisture within the ground was vertically permeated to build an aquatic environment suited to the field or rice paddies as well as improving the quality of the wet-fields. In this case, a care must be taken to prevent the underground space from being filled up with the passage of time. Actually, however, the surface soil in the field falls through an upper opening of the slit formed by the plow of the subsoiler into the slit space with the result that said slit space has been filled up as time goes on, thus frustrating the original objective.

In a peat bog, the field surface is made of clay which tends to close or fix an open slit due to plasticity and resiliency of the soil forming the underground space, thus failing the function expected as the underdrain.

It is also proposed to bury unglazed ceramic pipes in position for collecting the vertically permeating water but such pipes are merely connected in series. Therefore, the pipes can be disconnected as a result of aging to such a degree that sufficient drainage was not effected, thus making the service life of the underdrain short.

SUMMARY OF THE INVENTION

In order to solve the problems discussed in the foregoing, there is provided in the present invention a method of operation to excavate an underdrain comprising the steps of attaching a plurality of buckets for continuous movement in a vertical plane, moving said buckets horizontally by means of a tractor to form a slit in the field ground, setting out the sides of said slit by a reformer, pressing earth from both sides of said slit at an intermediate portion thereof to define an upper space and a lower space, charging said upper space with dirt excavated and discarded by said buckets to make said lower space independent after said lower space being worked on by rotors attached to a sprocket of the chain to form an underdrain having a substantially circular cross section to function as a drainage pipe and a device for such operation.

While the soil removed by the lit reformer in the lower space is pressed, the upper space is charged with dirt discarded by the buckets from the transitional position of the ascending move and the descending move to cover the slit, thus preventing unnecessary fall of the dirt or earth from outside such that the closure of the underdrain is made.

DESCRIPTION OF THE EMBODIMENTS

Figure 1:
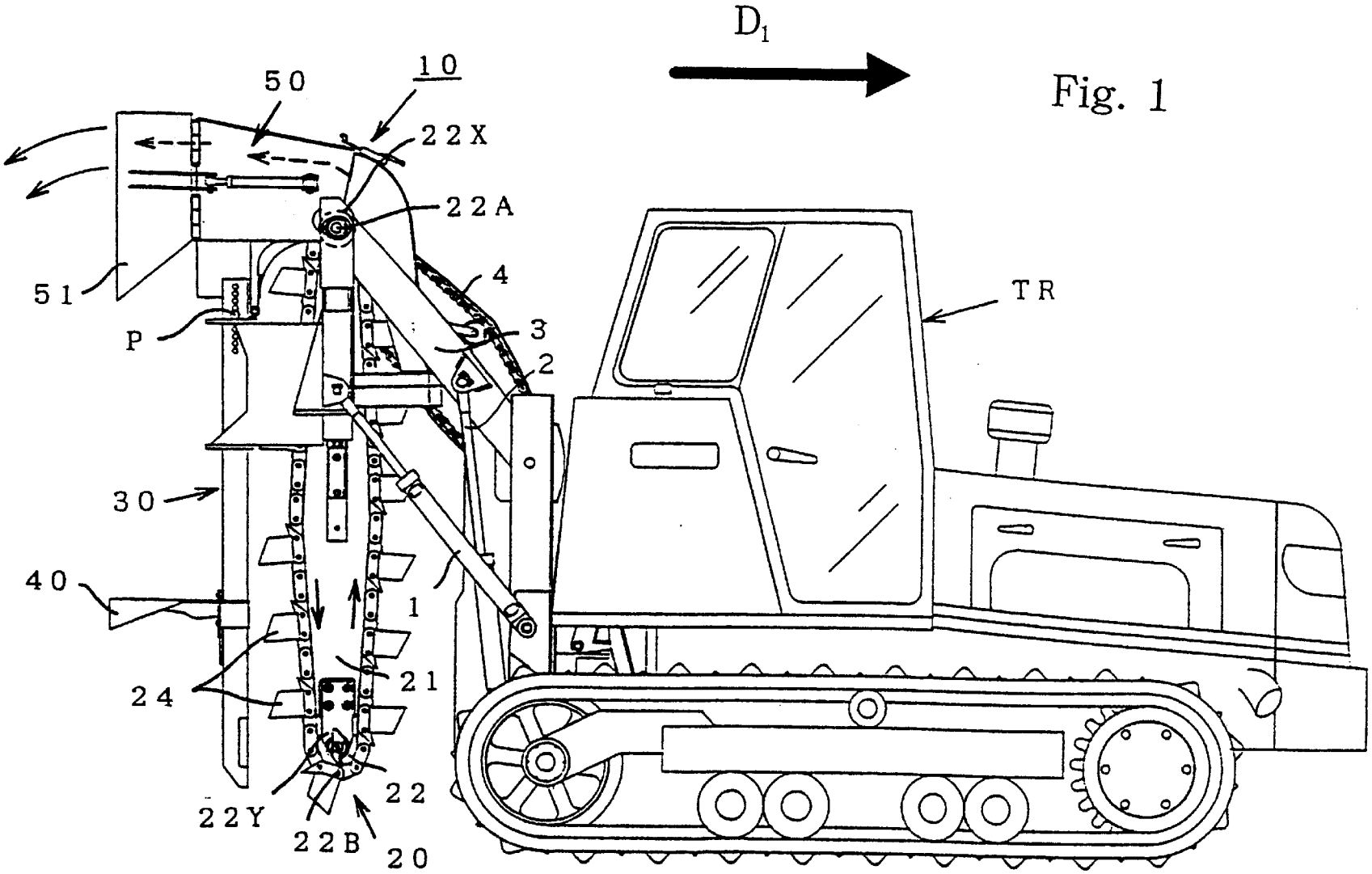
FIG. 1 is a side elevation of a tractor equipped with a device for operation to excavate an underdrain according to the present invention.

Now, a method for operation according to the present invention and a device suited for such operation will be described with reference to the attached drawings including FIG. 1 through FIG. 15. Referring to FIG. 1, TR generally denotes a tractor which is of a well-known crawler type. Said tractor TR is attached with an underdrain excavator 10 including four hydraulic cylinders 1 and 2 and support members 3 supported by said cylinders 2 and is adapted to travel in the arrow-marked direction $D_1$.

Said underdrain excavator 10 comprises a digging section 20 having on frame 21 supported by said support members 3, a reformer knife member 30 arranged rearwardly of said digging section 20, and a pressing member 40 attached to said reformer knife member 30.

Said digging section 20 supported by the support member 3 includes a support plate 21 provided in a vertical plane, said support plate being attached with a pair of sprockets 22X and 22Y by way of axles 22A and 22B at respective upper and lower ends thereof. An endless chain 23 is passed around said sprocket 22X and said sprocket 22Y attached to the support plate 21. Of the two sprockets, the sprocket 22X plays a part of a drive element to drive the chain 23 which in turn drives the sprocket 22Y. Actually, however, there is a transmission chain 4 passed around a receiving sprocket (not shown) coaxial to said sprocket 22X. Said transmission chain 4 is driven by a PTO axle (not shown) of the tractor TR. Said support plate 21 has a function to maintain the spacing of the tight end and the loose end of said chain 23.

Figure 2:
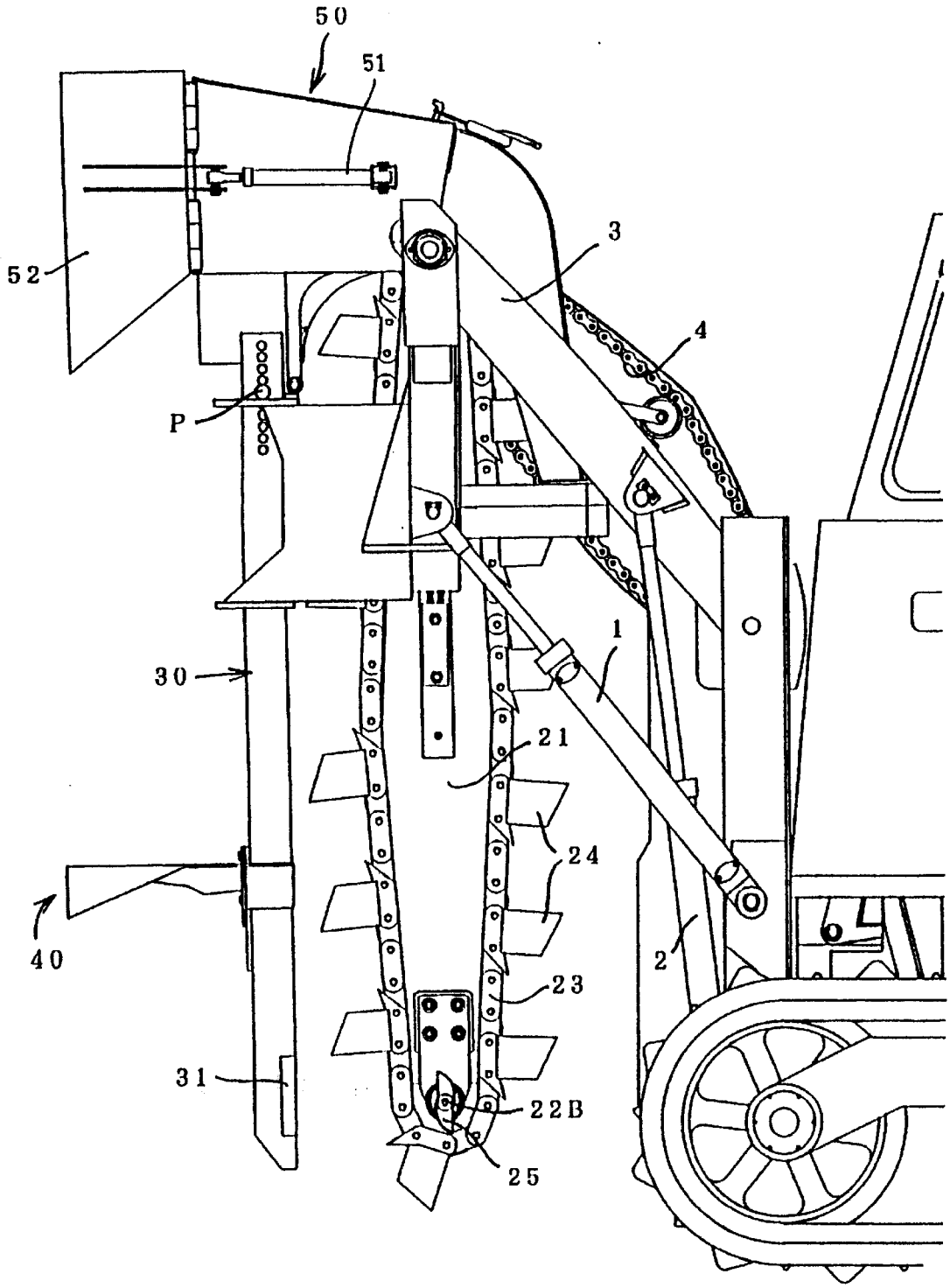
FIG. 2 is a side elevation of the digging section.
Figure 3:
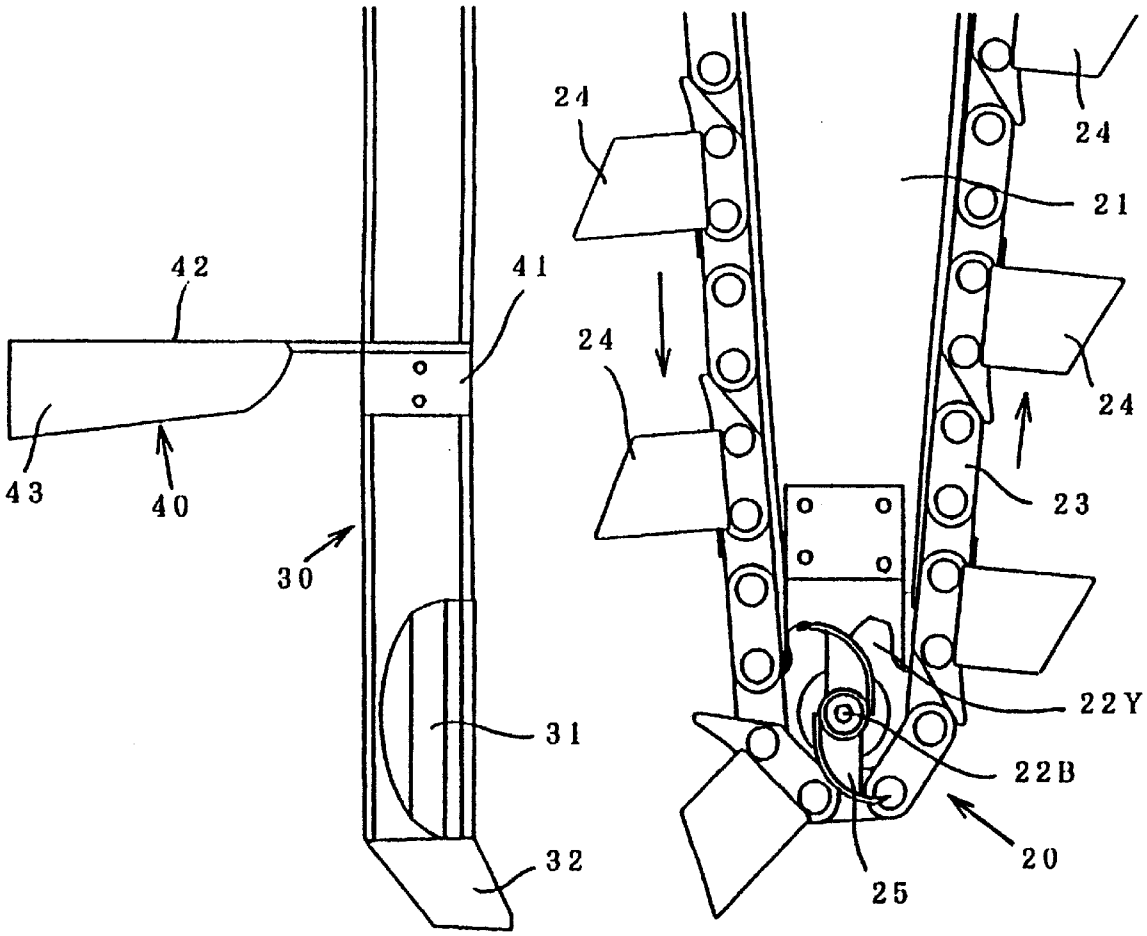
FIG. 3 is a side elevation of the lower portions of the digging section and the reformer knife member.

As better shown in FIG. 2, said endless chain 23 has a plurality of excavating buckets 24 arranged at regular intervals with the ascending run thereof being on the tractor side and the descending run being disposed rearwardly thereof to be driven to make a circuit. Each bucket 24 performs an excavating action at the beginning of the ascending run while it may discard the dirt scooped therein rearwardly during the transition from the ascending run to the descending run through a dirt discard guide 50 as will be explained later on.

Figure 4:
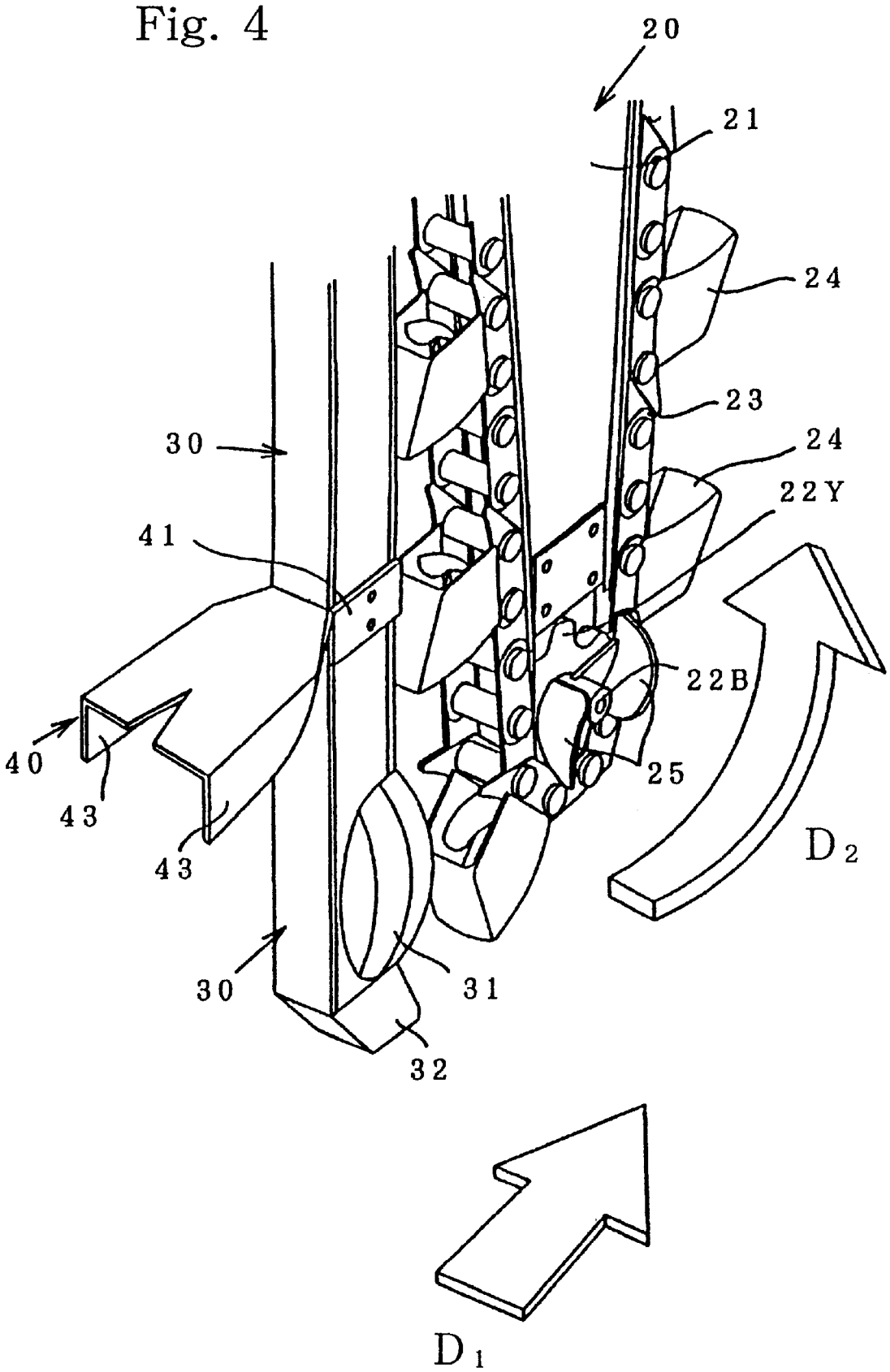
FIG. 4 is a perspective view of the digging section and the reformer knife member shown in FIG. 3.
Figure 5:
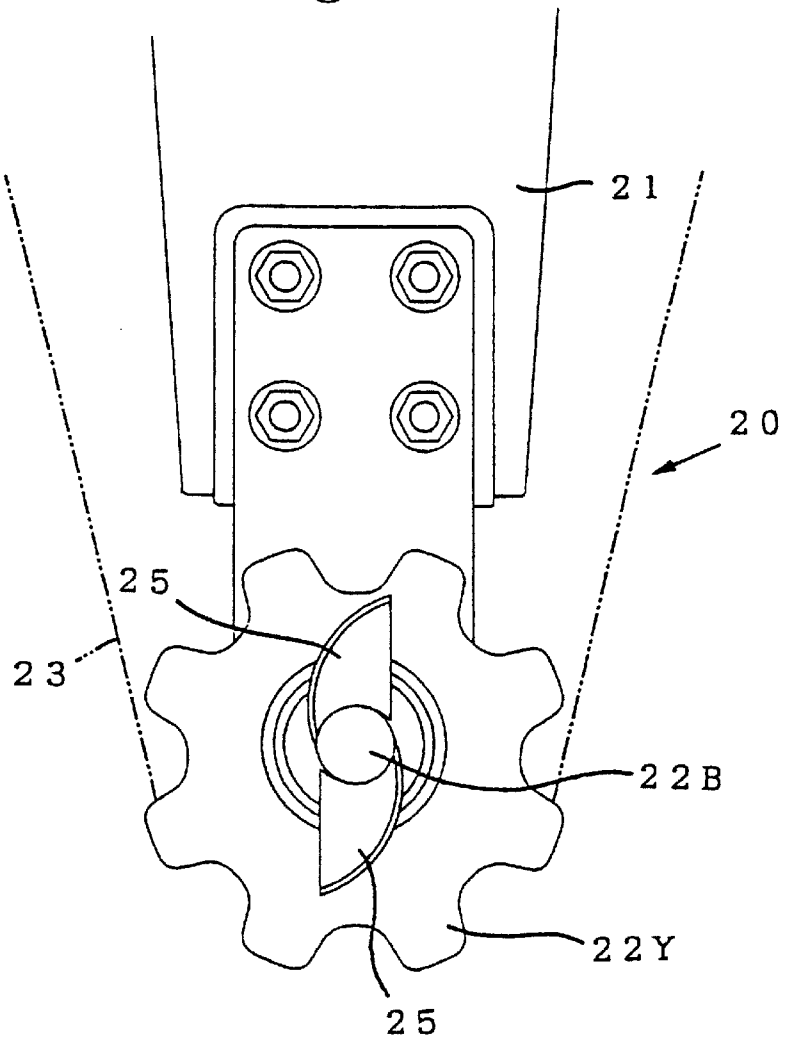
FIG. 5 is a side elevation of the lower portion of the digging section except for the chain.
Figure 6:
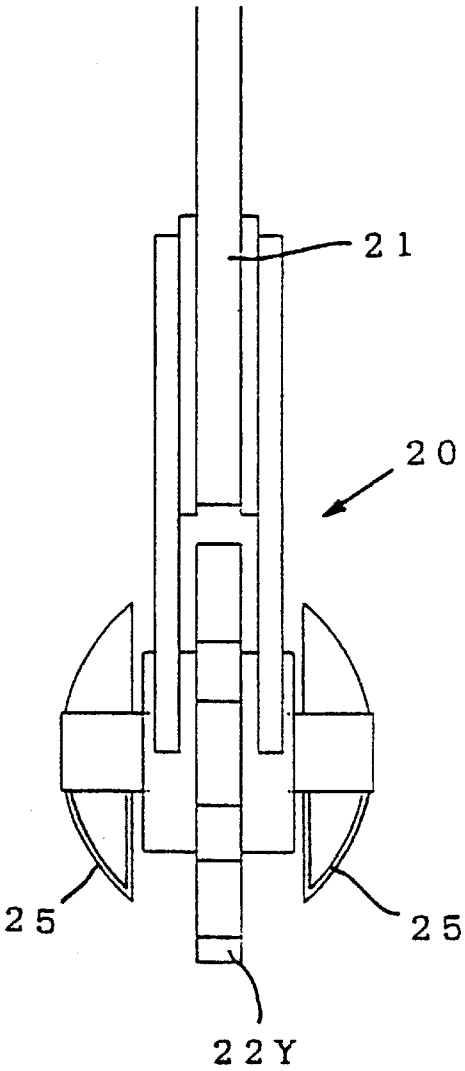
FIG. 6 is a back side view of the digging section shown in FIG. 5.
Figure 7:
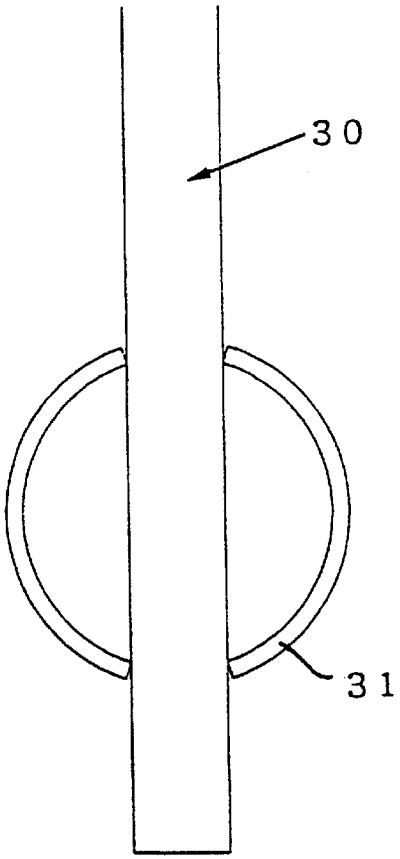
FIG. 7 is a back side view of the lower portion of the reformer knife member.
Figure 8:
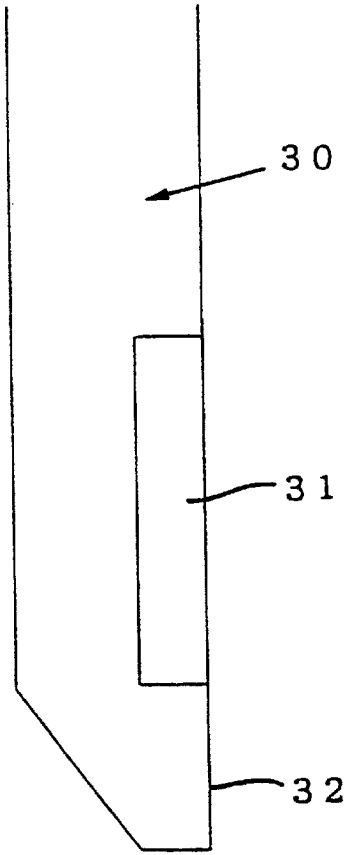
FIG. 8 is a side elevation of the reformer knife member shown in FIG. 7.
Figure 9:
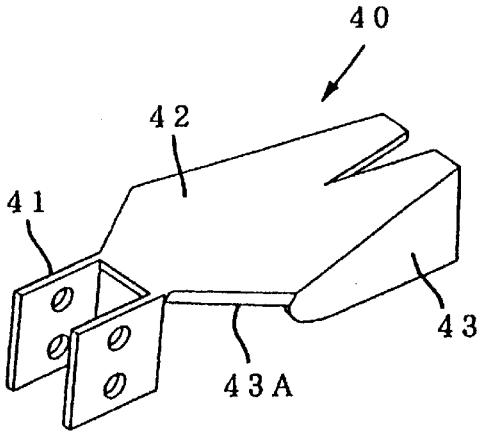
FIG. 9 is a perspective view of the pressing member.

As shown in FIGS. 2 through 6, rotors 25 are provided at the support axles 22B on both sides of the sprocket 22Y. Said rotors 25 are forced to rotate in the direction $D_2$ when the sprocket 22Y is driven. As best shown in FIG. 4 and FIG. 6, each rotor 25 has an intermediate portion thereof widest and end portions thereof which gradually become narrower such that the locus thereof is a substantial circle as viewed in the direction of travel of the device, permitting an underdrain to be formed and perform a function of a drain pipe.

Figure 11:
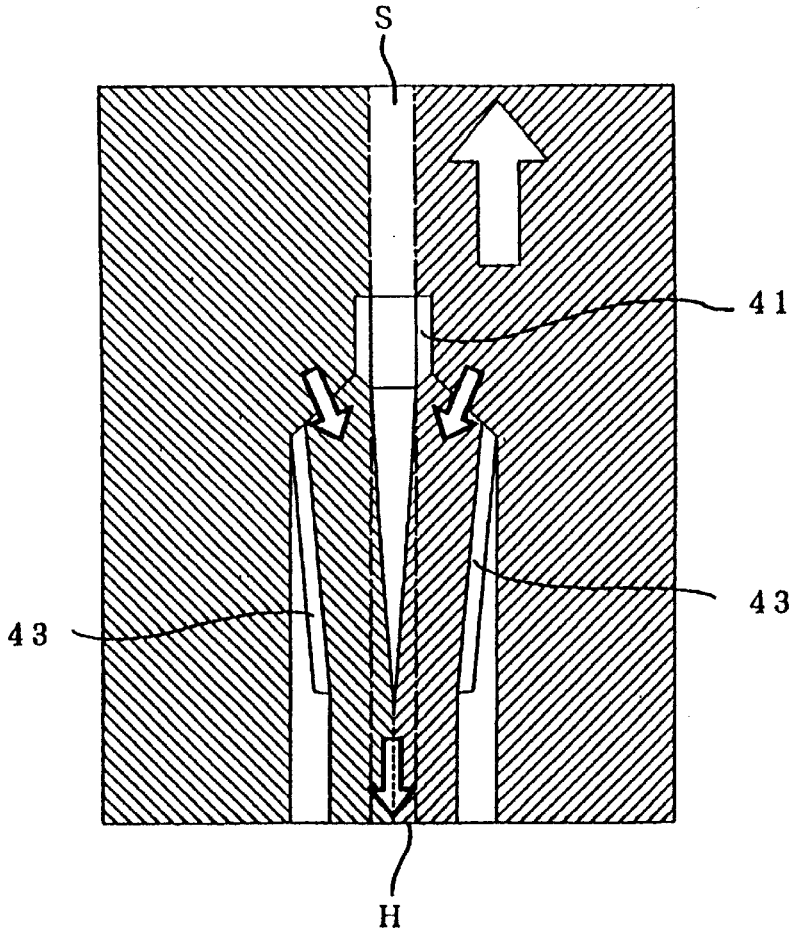
FIG. 11 is a sectional plan view showing the slit being blocked by the pressing knife member.
Figure 12:
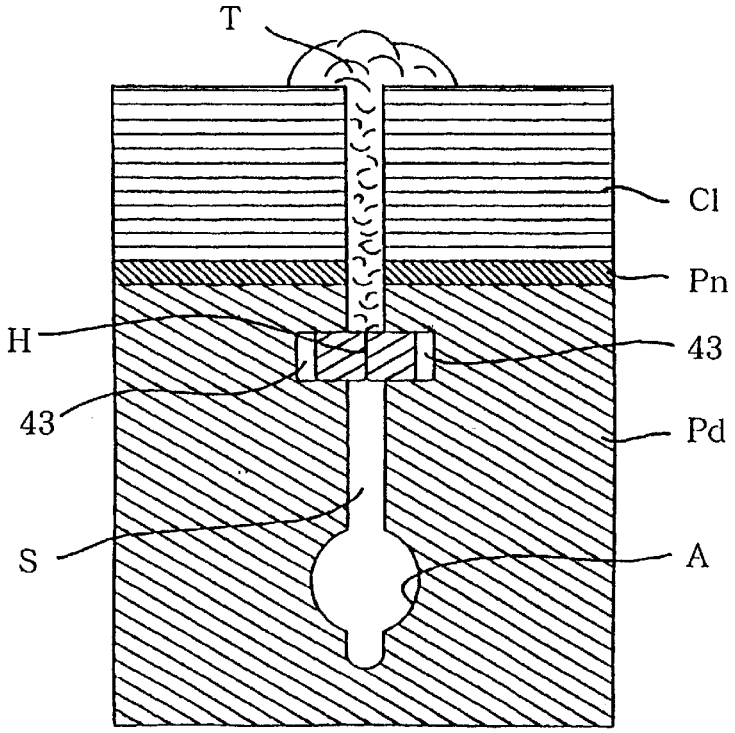
FIG. 12 is a sectional view of the field formed with the underdrain.

It may be easily understood that the driven endless chain 23 causes the buckets attached thereto to work on the ground. As a result of this action, a slit S is excavated in the ground as shown in FIGS. 11 and 12. The reformer knife member 30 shown in detail in FIGS. 7 and 8 in the shape of a knife is provided in a plane including said slit S so as to set out the sides of said slit S. As best shown in FIG. 1, said reformer knife 30 is attached through pins P to the framework forming the device 10 such that the depth of the digging work through the ground is selected by adjusting the pin positions. While the width of the reformer 30 is sized slightly larger than the slit width or the width of each bucket 24, the vertical size thereof is set to the lowest reach of each bucket 24 such that the lower end of the bucket protrudes downwardly of the reformer knife member 30.

Further, said reformer knife member 30 is formed with a pair of semi-circular enlargements 31 extending in the direction of the width of the reformer knife member 30 at the lower portion thereof such that the inside walls of a circular space formed by the rotors 25 may be set or reformed. Furthermore, the lower end of the reformer knife member 30 is in the form of a chisel which sets out the floor portion of the bucket locus.

Furthermore, the reformer knife member 30 is attached at a vertically intermediate portion thereof with a pressing member 40, which is formed with a pair of brackets 41 for attachment onto the reformer knife member 30. Integrally with said brackets 41, a base plate 42 extends into the opposite direction of travel. Downwardly front both side edges of the base plate 42 extends a pair of pressing side plates 42 such that the distance therebetween converges rearwardly while the lateral cross section thereof is channel-shaped. Further, the bracket side of the side walls are allowed to define openings 43A to introduce the dirt into a space defined by the base plate 42 and the side walls 43 during the operation.

Thus, the dirt collected from the walls of the slit S and pressed by and between the pressing side walls 43 of the pressing member 40 is centrally forced inwardly to close the slit S in the course of the operation to form a closing block H as seen in FIGS. 11 and 12. Said closing block H separates the slit S into upper and lower spaces. While the upper space is allowed to receive discarded dirt and be charged therewith as will be explained later on, the lower space remains as a space in the form of a guiding passage for introducing permeating water to the underdrain A formed at the lowest level.

Further, the excavating device 20 has a dirt discard guide section 50 at an upper portion thereof to cover a transitional area of the buckets 24 from the ascending move to the descending move. Said dirt discard guide section 50 is open rearwardly and attached with a closure plate 52 attached thereto by way of hinges such that said closure plate 52 is driven to close said dirt discard guide section 50 by the contraction of the hydraulic cylinder 51 shown in FIG. 1. When the closure plate 52 is shut, the dirt impinges on the shut closure plate to be deflected laterally. When the plate 52 is opened, the dirt is discarded rearwardly instead of impinging on the plate 51 to fill the upper space of the slit S.

The operation and the work by use of the device according to the present invention will be explained in more detail hereinafter. First of all, the device 10 is attached to the tractor TR such that the device is driven by the power source which the tractor carries.

Figure 10:
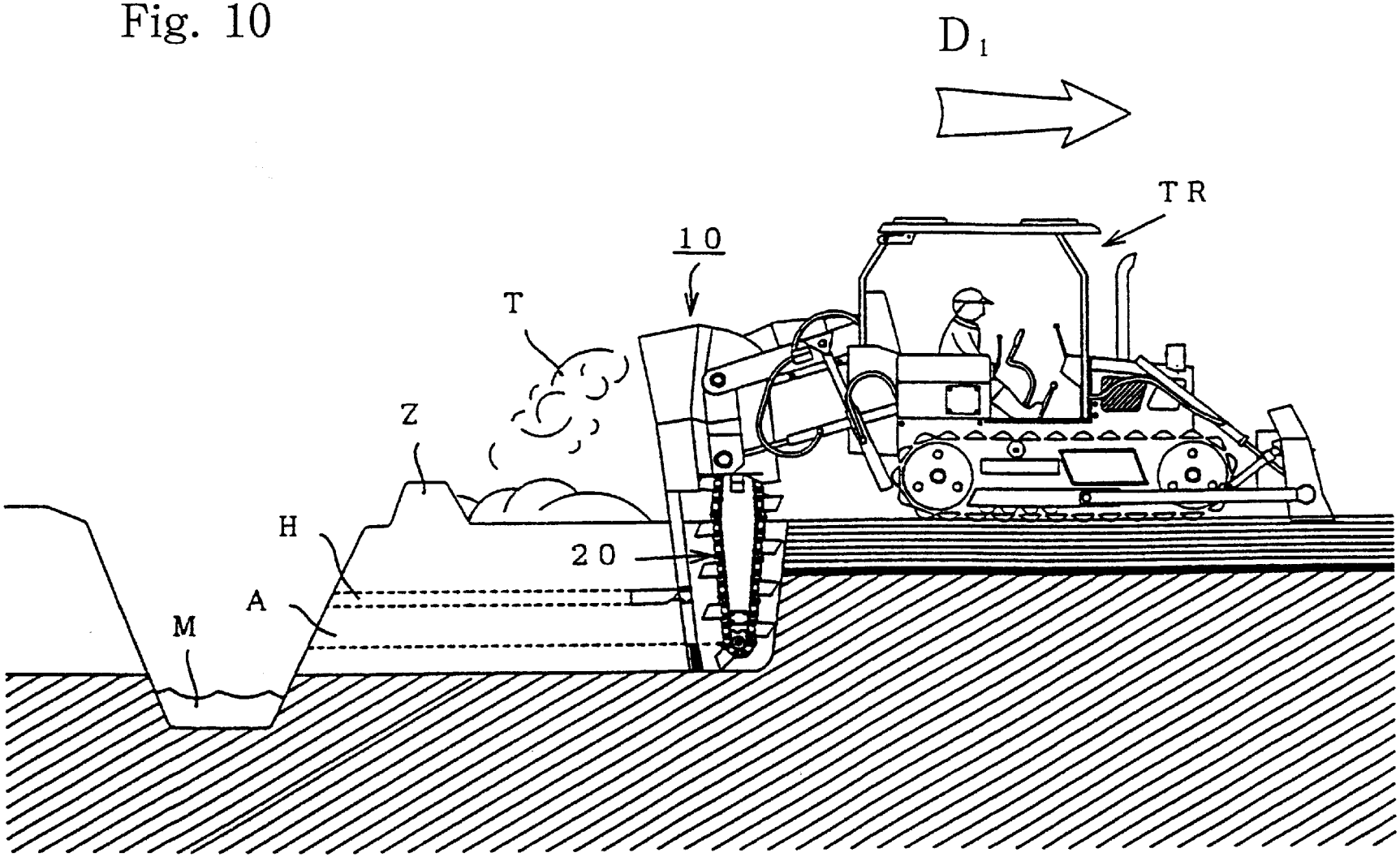
FIG. 10 is a explanatory side elevation showing the progress of the operation.

Then, there is a need to lower the device 10 such that the digging section 20 reaches the level desired to form the underdrain A. For this purpose, the hydraulic cylinders 2 are contracted and the cylinders 1 are extended until the digging section 20 is lowered as shown in FIG. 10. In this state, the operation is started from an open drain M through a ridge Z (in the arrow-indicated direction $D_1$ of the operation).

Figure 13:
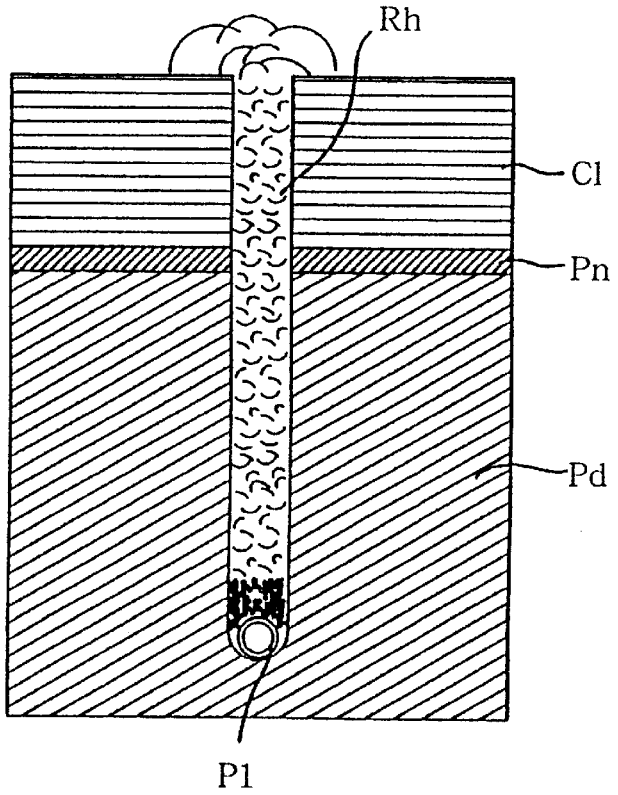
FIG. 13 is a sectional view of the field covering the underdrain with filling materials.
Figure 14:
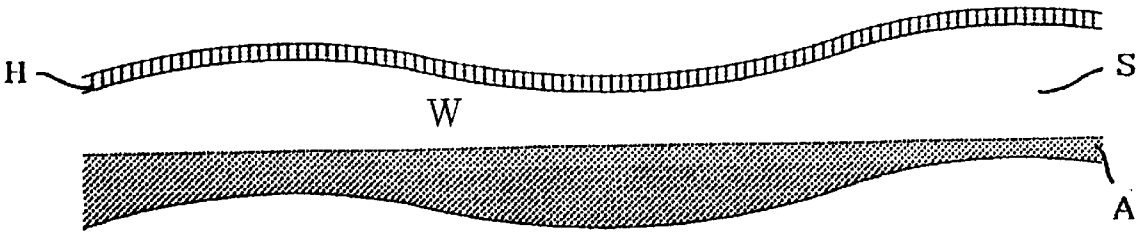
FIG. 14 is a sectional view of the field formed with an underdrain.

While the digging section 20 is driven by the transmission chains 4, and the sprockets 22X and 22Y, the tractor is also needed to run for operation. When the excavation is performed with the tractor being driver to run, the clay layer Cl, the pan of plow bottom Pn, and peat deposits Pd are cut through as shown in FIG. 12 and FIG. 13. In the meantime, the dirt excavated by the ascending action of each bucket 24 is discarded rearwardly when the bucket changes the course at the top of the ascending run of the chain 23. During this movement, a slit S is formed in the ground. While the rotors 25 rotate to form the underdrain A of circular cross section at the bottom portion of the slit S, the reformer 30 following the digging section 20 set out the sides of the slit S to reform the slit walls. Thus, water W is allowed to flow through said underdrain A as shown in FIG. 14. It is also possible to form an underdrain A of a suitable shape by selecting the shape of the rotors 25. Further, since the pressing member 40 attached to the reformer knife member 30 is adapted to introduce the side walls of the slit S through the openings 43A formed between the pressing plates 43 whereas the space defined by the base plate 42 is formed to converge in the opposite direction of travel, the dirt scraped off from the side walls of the slit S is tightly pressed to such an extent that the closing block H is formed at a vertically intermediate portion of the slit. Therefore, the slit space is divided into two by the closing block H after the passage of the digging section 20 to make the underdrain A a closed space.

Further, the dirt excavated by each bucket 24 of the digging section 20 is discarded by a centrifugal force rearwardly through the dirt discard guide 50 at the top of the transitional area of the bucket from the ascending love to the descending move, in other words, at the time of bucket reversion along the sprocket 22X and the thus discarded dirt falls onto the upper space of the slit S to be charged therein to.

Figure 15:
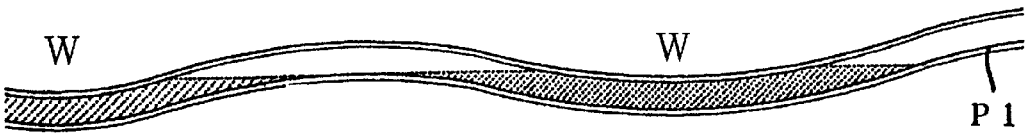
FIG. 15 is a sectional view of the underdrain.

As shown in FIG. 13, in case a filling materials such as rice husks Rh are to be charged in the space of the slit S, the closing plate 51 of the dirt discard guide 50 is closed. In other words, the hydraulic cylinder 52 is extended to direct the plate 51 laterally of the direction of travel. Therefore, the dirt will not be charged into the slit S, which is left open. In such an instance, a water permeable pipe P1 of unglazed material is buried at the bottom of the slit S and the pipe P1 may be covered by reed, hay and etc. FIG. 15 shows that water W is allowed to flow through said water permeable pipe $P_1$.

Further, since the enlargement 31 provided at the lower end of the reformer knife member 30 has a contour similar to the underdrain A formed by rotors 25, the space or the underdrain A is reformed thereby to prevent the deformation thereof.

As explained in the foregoing, the method of operation to excavate an underdrain and a device for such operation of the present invention reside in that a slit space is formed by buckets acting as excavating pawls, said slit is formed with a closing block at a vertical intermediate portion thereof to separate the space into two, the upper space is charged with the discarded dirt from the buckets to cover the slit, the lower space blocked by the block formed as a result of pressing of the dirt in the slit acts as an independent underdrain from the field surface to prevent an external dirt entry thereinto, thus forming a perfect underdrain having a long service age.

Since the discarded dirt is charged in the vertical intermediate portion of the slit while forming the closing block thereat simultaneously with the operation, the slit will not be destroyed during such operation to assure that the underdrain is firmly formed.

Further, since the pressing member is adapted to press the soil from both sides of the slit laterally centrally to form a closing block, the operation is performed continuously and since the slit is firmly set at both side walls by the reformer, it is most suited for the operation at peat bog fields.

Moreover, the driven sprockets and the rotated rotors assure the formation of the internal surfaces of the underdrain while the enlargements set the internal faces.

What is claimed is:

1. A method of operation to excavate an underdrain comprising the steps of forming a slit cut through a field ground by driving a plurality of buckets attached to an endless chain to make a circuit to work on the field ground; forming an underdrain in communication with said slit at a floor portion thereof by means of rotors attached to sprockets at a lower transitional position for bucket movement; arranging a reformer knife member rearwardly of the moving buckets for reforming both side walls of the slit; closing said slit at a vertically intermediate postion by means of a pressing member attached to said reformer knife member; filling a slit upwardly of said closed position to define an underdrain at a lower portion of the slit.

2. A device for operation to excavate an underdrain comprising an endless chain set around sprockets vertically secured;

a plurality of buckets attached to said endless chain;

rotors arranged on both sides of one of the sprockets at a lowest position of said endless chain;

a reformer knife member provide rearwardly of the buckets to reform a slit formed in the ground;

a pressing member attached at a vertically intermediate position of said reformer member to press soil scraped off from both inner side walls of said slit to close the slit such that said slit is separated into an upper space and a lower space in the ground, said upper space being adapted to receive dirt discarded from said buckets.

3. A device according to claim 2, wherein said pressing member has a pair of side walls arranged to face each other with a spacing converging rearwardy.

4. A device according to claim 2, further including a guide adapted to selectively guide rearwardly or laterally the dirt discarded by each bucket at a transitional position from an ascending run to a descending run.

* * * * *